US010173121B2

(12) United States Patent
Watson

(10) Patent No.: US 10,173,121 B2
(45) Date of Patent: Jan. 8, 2019

(54) HAND WEARABLE VISUAL TRAINING AID DEVICE FOR GOLFING

(71) Applicant: Edward Bates Watson, Dana Point, CA (US)

(72) Inventor: Edward Bates Watson, Dana Point, CA (US)

( * ) Notice: Subject to any disclaimer, the term of this patent is extended or adjusted under 35 U.S.C. 154(b) by 0 days.

(21) Appl. No.: 15/399,515

(22) Filed: Jan. 5, 2017

(65) Prior Publication Data

US 2018/0185729 A1 Jul. 5, 2018

(51) Int. Cl.
*A63B 69/36* (2006.01)
*A41D 19/00* (2006.01)

(52) U.S. Cl.
CPC ..... *A63B 69/3608* (2013.01); *A41D 19/0003* (2013.01); *A41D 19/0027* (2013.01); *A63B 69/3623* (2013.01)

(58) Field of Classification Search
USPC ..... 473/201, 205, 206, 212, 213, 267
See application file for complete search history.

(56) References Cited

U.S. PATENT DOCUMENTS 4,257,607 A * 3/1981 Nedwick ..... A63B 69/3608 273/DIG. 30
5,156,399 A * 10/1992 Gauer ..... A63B 69/3608 2/160
5,230,513 A * 7/1993 Rouse ..... A63B 69/3608 473/205
8,142,299 B1 * 3/2012 Shah ..... A63B 69/0059 473/205

* cited by examiner

*Primary Examiner* — Nini Legesse

(57) ABSTRACT

A hand wearable visual training aid device worn by the hand of a golfer and for use with a golf club having a clubface is presented and described herein. The hand wearable visual training aid device includes a glove or hand strap and a clubface guide post mounted to the glove or hand strap. A clubface guide post mounted on the hand wearable visual training aid device is used to visually assist and guide the wrist of the golfer which, in turn, promotes clubface alignment prior to impact, providing a better strike and center hit for achieving greater accuracy and distance on the golf ball.

18 Claims, 19 Drawing Sheets

HAND WEARABLE VISUAL TRAINING AID DEVICE FOR GOLFING

FIELD OF THE INVENTION

The present invention relates to a golf training aid device. In particular, the present invention relates to a hand wearable visual training aid device for golfing.

BACKGROUND

Several conventional golf training aid devices exist to help a golfer improve their golf swing, thereby improving the stability and accuracy of the golfer's swing. Some of these training aid devices are designed to be attached to club grips of golf clubs, while other devices may be worn by the golfer. For example, golf training aid devices may include motion restricting or limiting devices that guide and limit the range of the hands of the golfer to be in the proper swing position. Other devices may include golf visual training devices that are attached to the golf club, providing a visual reference guide for setting the proper clubface orientation of the golf club prior to impact.

Although many golf training devices aid in improving posture, swing and golf club positioning, other training aid devices may be beneficial for improving consistency and power of the golfer's swing, resulting in better accuracy and range.

SUMMARY

It is an advantage of the present invention to provide a hand wearable visual training aid device for use with a golf club having a clubface, the hand wearable visual training aid device includes a glove having a top side, a palm side opposite to the top side, a wrist end, a plurality of openings opposite to the wrist end; and a clubface guide post coupled to the top side of the glove and substantially centrally positioned to the top side of the glove, where the clubface guide post provides a visual reference for aligning the clubface of the golf club to a golf ball.

In another embodiment, the clubface guide post is substantially perpendicular to the top side of the glove.

In yet another embodiment, a hole is formed in the glove for receiving the clubface guide post.

It still yet another embodiment, the clubface guide post includes an elongated cylindrical tube or rod coupled to a thin cylindrical support base.

In one aspect, the clubface guide post is secured to the glove by a circular patch, wherein a padding is applied between the bottom of the thin cylindrical support base and the circular patch.

In yet another aspect, the hand wearable visual training aid device includes a wrist support strap attached to the wrist end of the glove.

In still yet another aspect, the clubface guide post includes a tapered elongated cylindrical tube or rod coupled to a thin cylindrical support base.

In another aspect, the clubface guide post includes a plurality of printed markings applied to the surface of the elongated cylindrical tube or rod.

In some embodiments, the elongated cylindrical tube is defined by a hollow interior having an interior wall, wherein an illuminate light source is coupled to the interior wall of the elongated cylindrical tube.

In another aspect, the clubface guide post includes an extending member insert coupled to the elongated cylindrical tube.

In yet another aspect, the clubface guide post includes an elongated cylindrical tube or rod coupled to a base support post using a swivel ball joint.

It is another advantage of the present invention to provide a hand wearable visual training aid device for use with a golf club having a clubface, the hand wearable visual training aid device includes a hand strap having a top side, a palm side opposite to the top side, a first end, a second end opposite to the first end, and a back hand support pad coupled to the top side of the hand strap; a fastener applied to the first end and the second end of the hand strap; a clubface guide post coupled to the top side of the hand strap and substantially centrally positioned to the top side of the hand strap, where the clubface guide post provides a visual reference for aligning the clubface of the golf club to a golf ball.

In one aspect, the fastener is a hook and loop fastener.

These and other objects, features and advantages of the present invention will become more apparent in light of the following detailed description of preferred embodiments thereof, as illustrated in the accompanying drawings.

BRIEF DESCRIPTION OF THE DRAWINGS

The present invention will be more clearly understood from the following detailed description of the preferred embodiments of the invention and from the attached drawings, in which.

In the appended figures, one or more elements may have the same reference numeral in different figures indicating previously described elements.

DETAILED DESCRIPTION

Properly orientating and positioning a golf club can be challenging and difficult for many golfers. In a typical golf club design, the main parts of the golf club include a grip, a shaft, and a head. The head of the golf club has two sides known as a clubface and a back. In practice, the ideal is to get the clubface to a golf ball perpendicular at impact. With respect to the clubface, it may be difficult to achieve a proper center-face impact of the clubface due to improper golf club handling techniques.

Figure 1:
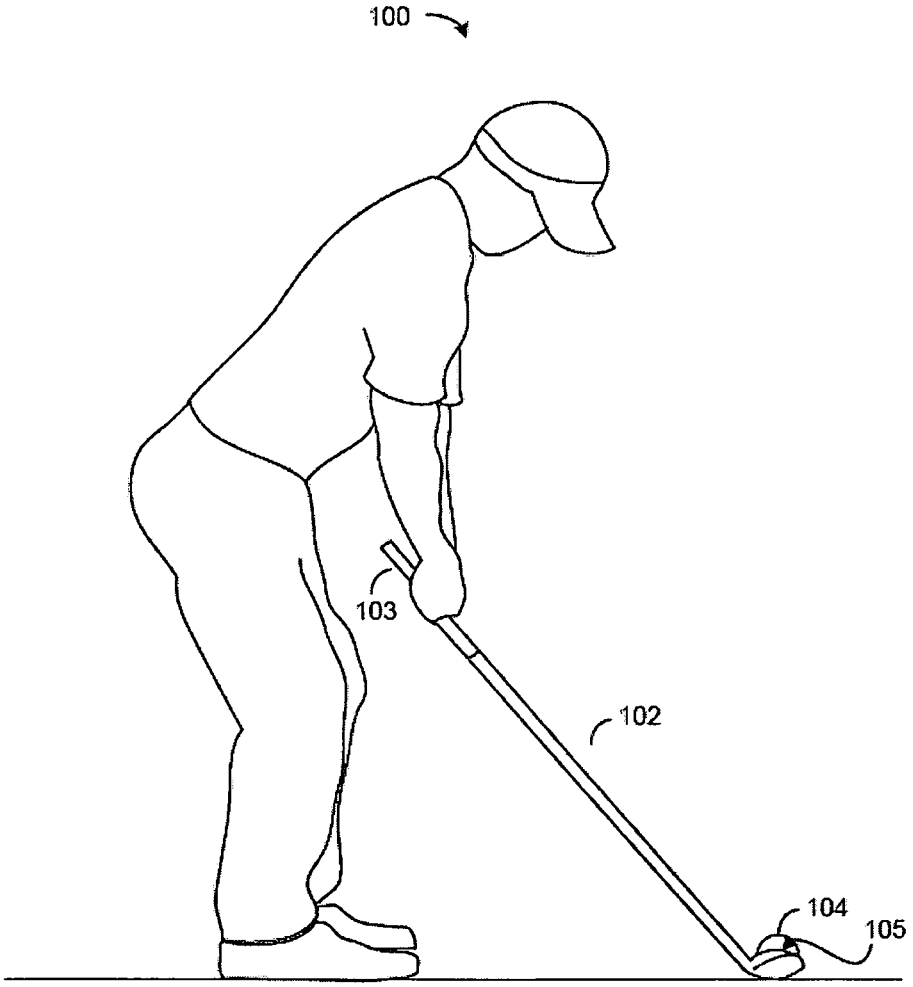
FIG. 1 illustrates a posture and alignment of a golfer gripping a golf club at address position.

FIG. 1 illustrates a golfer 100 with a golf club 102 at address or starting position. At address position, the clubface of the golf club 102 is positioned on an imaginary target line. A golf ball 104 is placed along the imaginary target line so that the clubface 105 of the golf club 102 is substantially perpendicular to the golf ball prior to impact. In practice, the top of the grip 103 of the golf club points directly at the golfer 102 while the clubface points directly at the target line. As previously mentioned, improper and poor club handling techniques can and often lead to inconsistent and ineffective golf swings at impact. For example, a slight shift in rotation of the golf club 102 can adversely affect the clubface alignment at impact, resulting in less distance and accuracy. To overcome this problem, a visual reference device may be used to aid and facilitate consistent wrist alignment techniques of the golfer prior to impact.

Figure 2A:
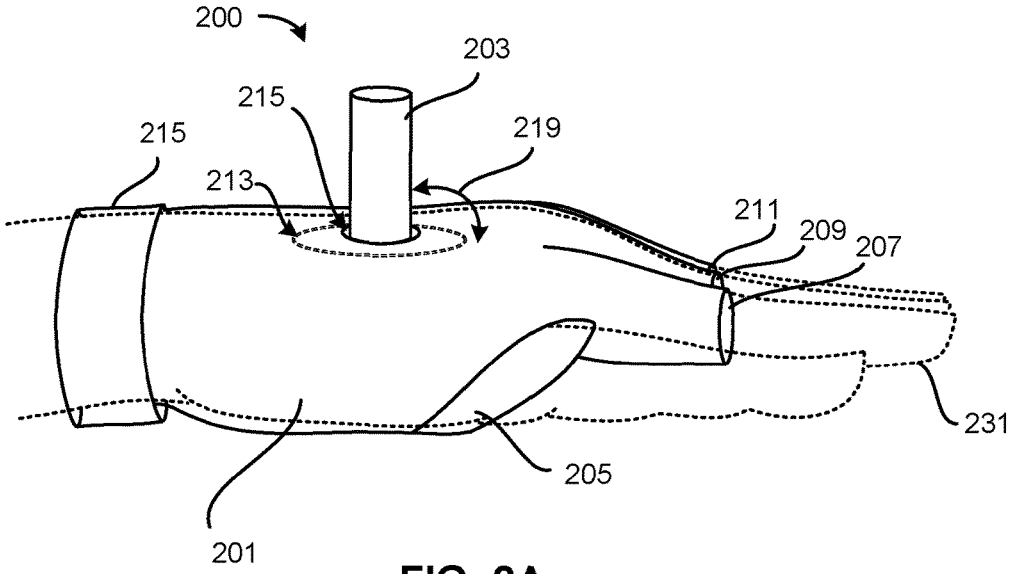
FIG. 2A illustrates a side view of a glove type hand wearable visual training aid device, in accordance with an embodiment.
Figure 2B:
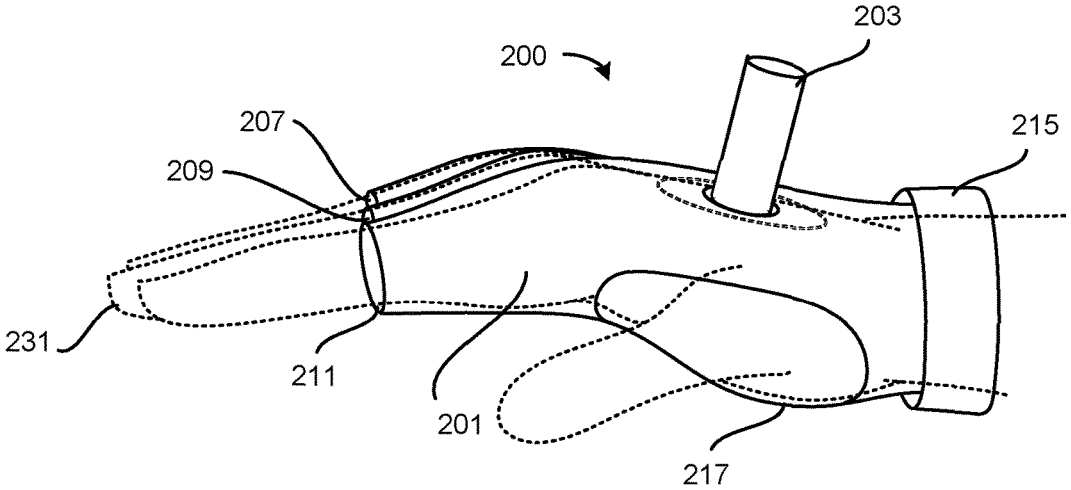
FIG. 2B illustrates the opposite side view of the glove type hand wearable visual training aid device, in accordance with an embodiment.

FIG. 2A and FIG. 2B illustrate a pinky side view and thumb side view, respectively, of a hand wearable visual training aid device 200, in accordance with an embodiment. The hand wearable visual training aid device in this embodiment may include a glove 201, a wrist support strap 215 attached to the wrist end of the glove 201, and a clubface guide post 203 mounted to the glove 201. The clubface guide post 203 is inserted through an opening 215 (for example, a hole) in the glove 201 and substantially positioned near the center of the top of the glove 201. In one example, threads and cross-stitching 213 may be used to secure and fasten the clubface guide post 203 to the glove 201, though other fastening techniques may be employed. When worn on the hand of the golfer, the clubface guide post 203 is positioned approximately near or at the center of the hand, substantially between the wrist and knuckle of the middle finger. In practice, the hand wearable visual training aid device 200 may be worn with or without a standard golf glove. To accommodate the standard golf glove, the glove 201 may be slightly oversized to receive and fit into the standard golf glove. To further enhance the fit, the glove 201 may be configured to have openings (pinky slot 205, index slot 207, middle slot 209, ring finger slot 211, thumb slot 217) to expose all fingers of the hand of the golfer, providing additional room and comfort. When mounted to the glove 201, the clubface guide post 203 is substantially perpendicular to the surface of the top of the glove (see reference angle 219).

Figure 2C:
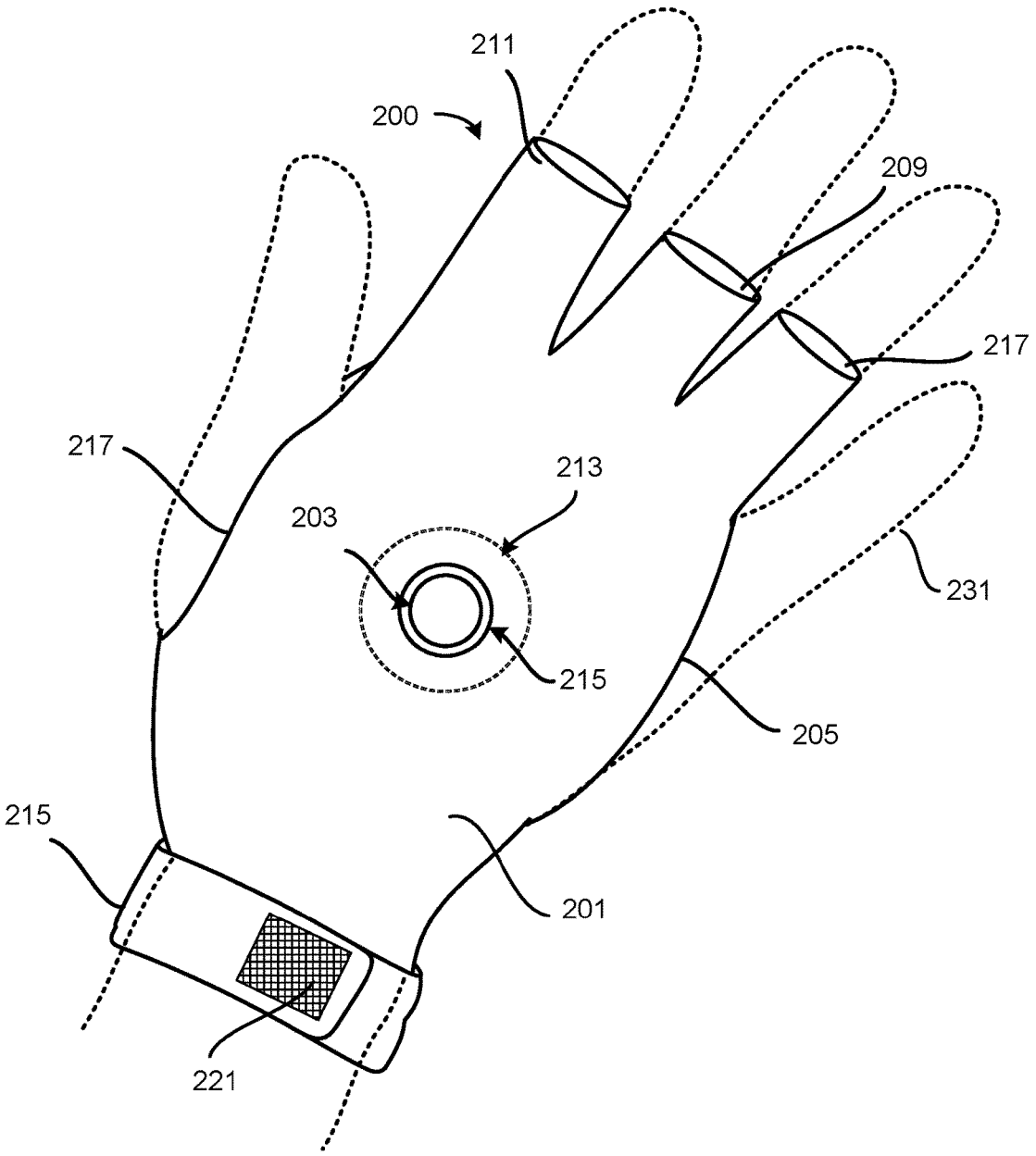
FIG. 2C illustrates a top side view of the glove type hand wearable glove visual training aid device, in accordance with an embodiment.
Figure 2D:
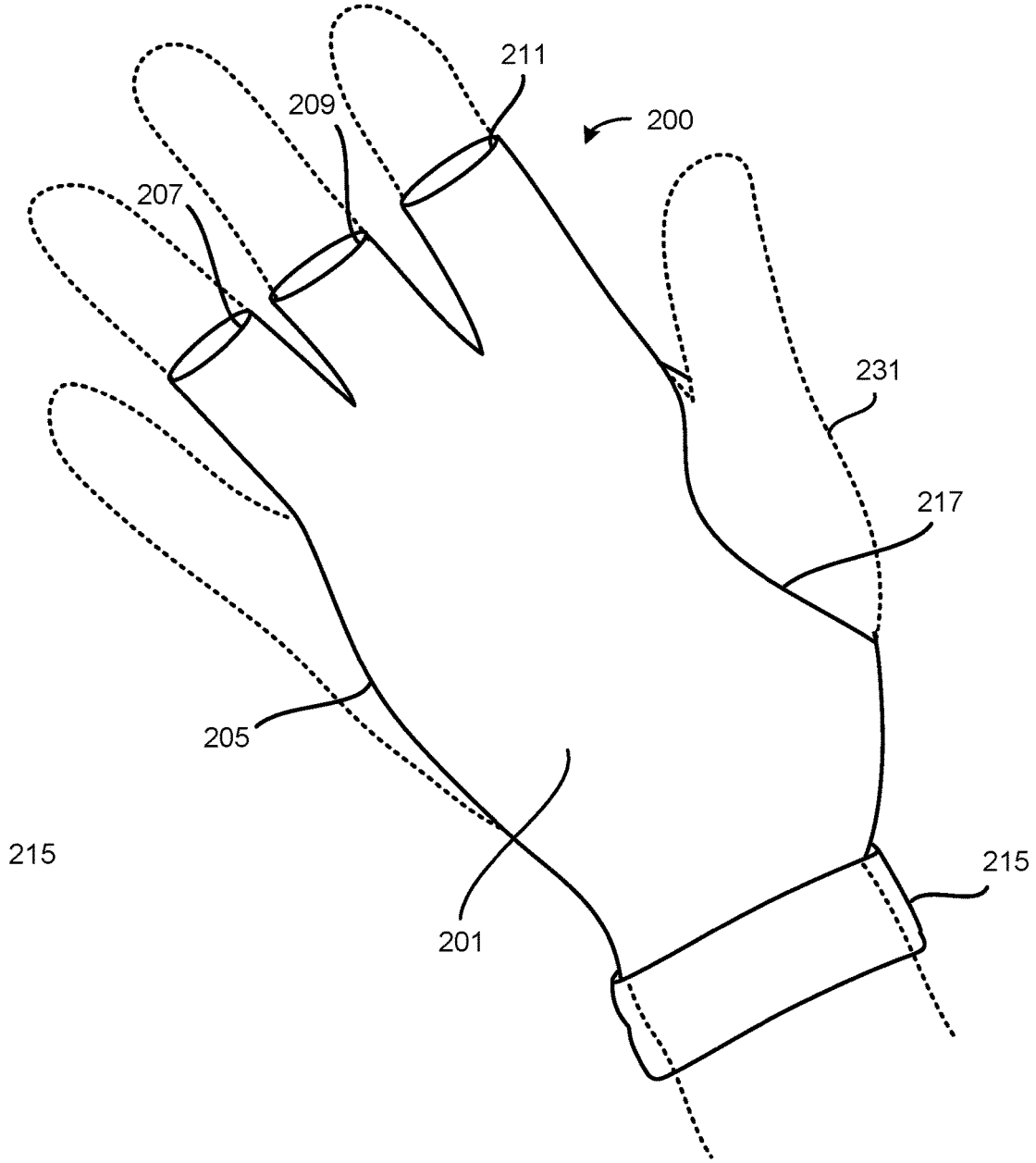
FIG. 2D illustrates a palm side view of the glove type hand wearable visual training aid device, in accordance with an embodiment.

FIG. 2C and FIG. 2D illustrate a top side view and a palm side view, respectively, of the hand wearable visual training aid device 200. As shown in FIG. 2C, the wrist support strap 215 may be adjustable, providing additional support, and firmly securing the glove 201 to the wrist of the golfer when worn by the golfer. A hook and loop fastener 221 may be used to attach each end of the wrist support strap 215, joining each end of the strap as shown in the top side view of FIG. 2C.

For illustration purposes, the hand wearable visual training aid device 200 shown in FIG. 2A through FIG. 2D is made to be worn on the right hand 231 of the golfer. For left-handed golfers, a left handed version of the hand wearable visual training aid device 200 may be made using a mirrored configuration of the hand wearable visual training aid device 200 presented hereinabove.

Various materials and manufacturing techniques may be used to fabricate the hand wearable visual training aid device 200. For example, some materials used to form the glove portion 201 may include leather, synthetic leather, cloth, knitted or felted wool, rubber, latex, neoprene, and metal. Fabrication techniques includes, for example, stitching and sewing techniques, 3D printing techniques, and other plastic injection molding techniques. Materials forming the clubface guide post 203 may include, for example, rubber, latex, plastics, PVC, wood and metal. In practice, the hand wearable visual training aid device 200 provides many benefits to golfer. Some of these benefits include, for example, a wearable device having a thin, ergonomic, portable, conforming, light-weight, and adjustable design.

Figure 3A:
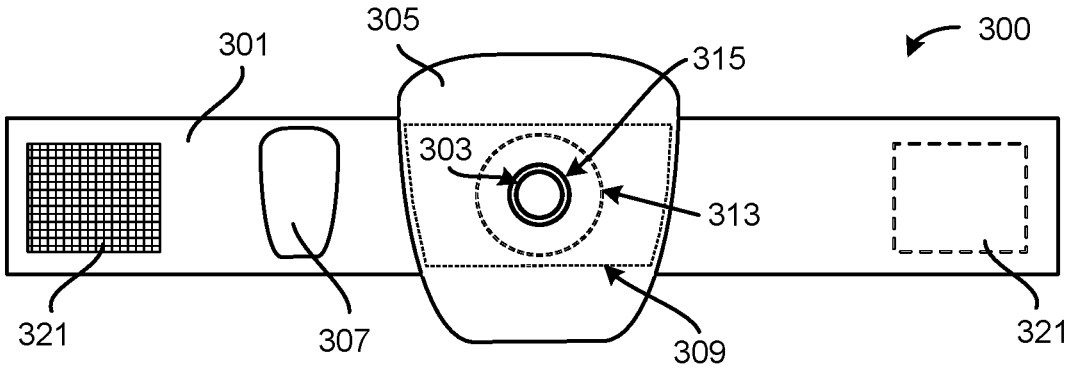
FIG. 3A illustrates a top view (top of hand) of a strap on hand wearable visual training aid device, in accordance with an embodiment.
Figure 3B:
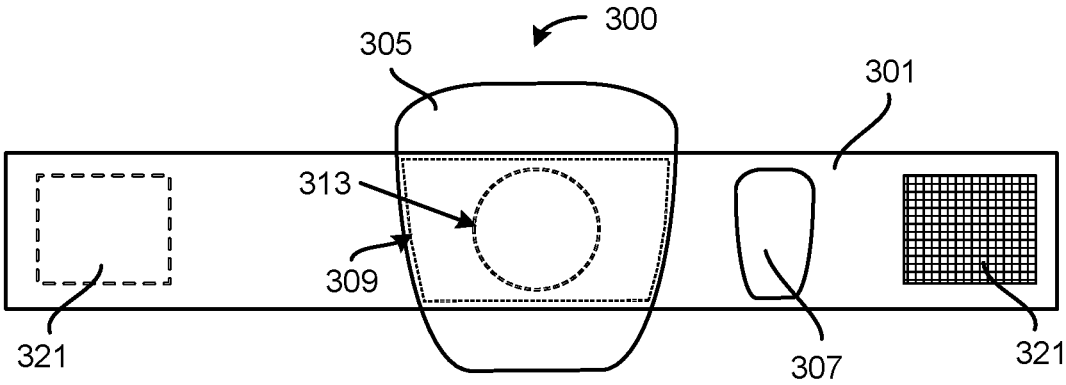
FIG. 3B illustrates a bottom view (palm) of the strap on hand wearable visual training aid device, in accordance with an embodiment.
Figure 3C:
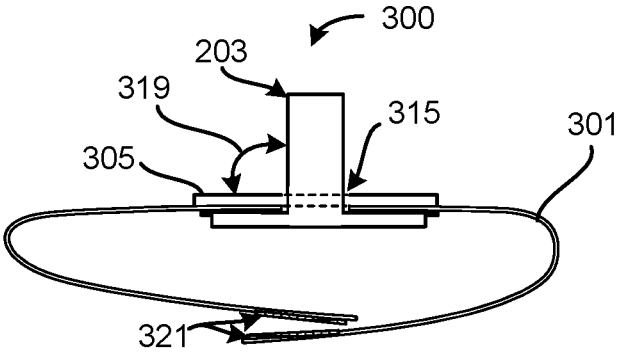
FIG. 3C illustrates a side view of the strap on hand wearable visual training aid device, in accordance with an embodiment.

FIG. 3A illustrates a top view (top of hand) of another embodiment of a hand wearable visual training aid device 300. The hand wearable visual training aid device 300 in this embodiment includes a hand strap 301, a back hand support pad 305 centrally positioned and attached to the strap 301, and the clubface guide post 203 (as presented in the previous embodiment) mounted to the hand strap 301. The clubface guide post 203 is inserted through an opening 315 (for example, a hole) in the hand strap 301 and back hand support pad 305, and substantially positioned near the center of the back hand support pad 305. In one example, threads and cross-stitching 313 may be used to secure and fasten the clubface guide post 203 to the hand strap 301, though other fastening techniques may be employed. When worn on the hand of the golfer, the clubface guide post 203 is positioned approximately near or at the center of the hand, substantially between the wrist and knuckle of the middle finger. In practice, the hand wearable visual training aid device 300 may be worn with or without a standard golf glove and may be configure to fit on either the left hand or right hand of the golfer. The hand wearable visual training aid device 300 may include an optional thumb insert slot 307 to accommodate the thumb of the golfer, providing a comfortable and conforming fit to the hand of the golfer. The optional thumb insert slot 307 may be formed on the left side of the back hand support pad 305 for a right-handed configuration or formed on the right side of the back hand support pad 305 for a left-handed configuration. As shown in FIG. 3A-3C, the hand strap 301 may be adjustable, providing additional support, and firmly securing to the wrist of the golfer when worn by the golfer. A hook and loop fastener 321 may be used to attach each end of the hand strap 301, joining each end of the hand strap 301 as shown in FIG. 3A-3C.

FIG. 3B and FIG. 3C illustrate a bottom view (palm) and a side view, respectively, of the hand wearable visual training aid device 300 showing previously described elements from the bottom side and the side, respectively.

Various materials and manufacturing techniques may be used to fabricate the hand wearable visual training aid device 300. For example, some materials used to form the strap portion 301 may include leather, synthetic leather, cloth, knitted or felted wool, rubber, latex, neoprene, and metal. Fabrication techniques includes, for example, stitching and sewing techniques, 3D printing techniques, and other plastic injection molding techniques. In practice, the hand wearable visual training aid device 300 provides many benefits to golfer. Some of these benefits include, for example, a wearable device having a thin, ergonomic, portable, conforming, light-weight, and adjustable design.

Figure 4:
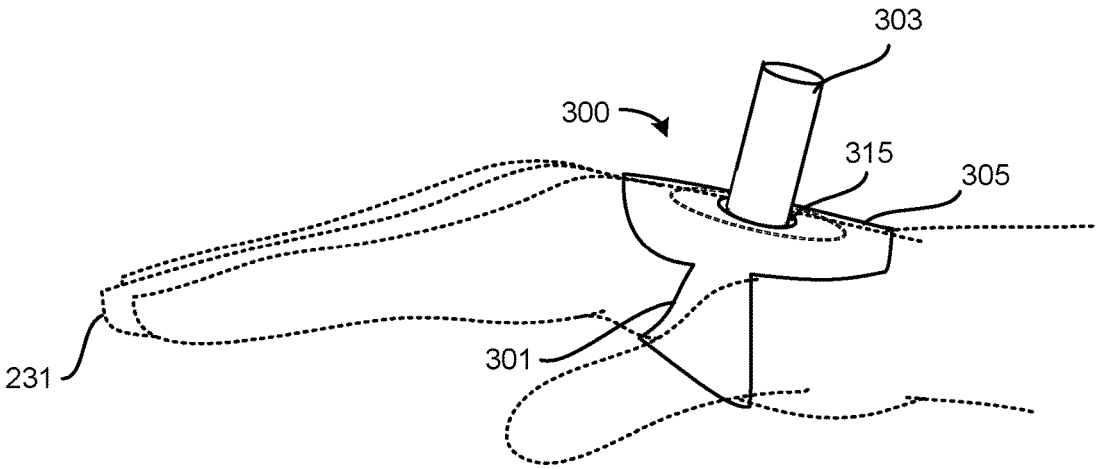
FIG. 4 illustrates a side view of the strap on hand wearable visual training aid device strapped to the hand of the golfer, in accordance with an embodiment.

FIG. 4 illustrates a side view of the hand wearable visual training aid strap device 300 applied to the right hand 231 of the golfer. In practice, the hand strap 301 wraps around the palm of the hand 231 while the back hand support pad 305 rest on the back of the hand 231 of the golfer. The shape of the back hand support pad 305 may be configured to match the profile, shape, and contour of the hand 231 for a ergonomic and comfortable fit. When mounted to the strap device 300, the clubface guide post 203 is substantially perpendicular to back hand support pad 305 (see reference angle 319).

Figure 5A:
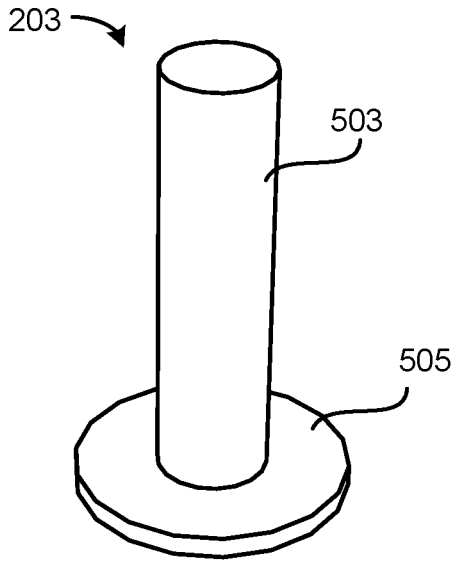
FIG. 5A illustrates an isolated perspective view of a clubface guide post of the hand wearable visual training aid device, in accordance with an embodiment.

FIG. 5A illustrates an isolated perspective view of the clubface guide post (203) of the hand wearable visual training aid device, in accordance with another embodiment. Members of the clubface guide post 203 may include an elongated cylindrical tube or rod 503 mounted to the center of a thin cylindrical support base 505. In practice, the dimensions of the elongated cylindrical tube or rod 503 may be approximately 2.5 inches to 4 inches in length with a radius of ¼ inch to ½ inch. The dimensions of the thin cylindrical support base 505 may be approximately ⅛ inch to ½ inch in length with a radius of ½ inch to 1 inch. In another implementation, other shapes of tubes and rods such as, for example, a square tubing, a rectangular tubing, a square rod, or a rectangular rod.

Figure 5B:
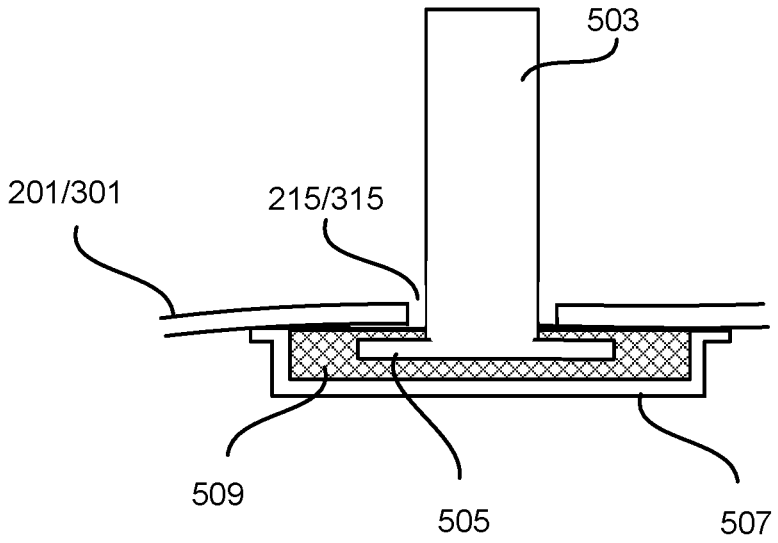
FIG. 5B illustrates a cross-sectional view of the clubface guide post mounted to the hand wearable visual training aid device, in accordance with an embodiment.

FIG. 5B illustrates a cross-sectional view of the clubface guide post 203 mounted to the hand wearable visual training aid device. The clubface guide post 203 may be mounted to the hand wearable visual training aid device by inserting the elongated cylindrical tube or rod 503 through the hole (215 or 315) of the body (201 or 301, respectively) of the hand wearable visual training aid device (200 or 300, respectively). A circular patch 507, which may be slightly larger and generally has the same shape as the thin cylindrical support base 505, may be fastened to the back side of the body (201 or 301) using thread and stitching, adhesives (glue), staples or other fastening techniques. The circular patch 507 is generally made from the same material as the body (201 or 301) and conforms to the body (201 or 301) of the hand wearable visual training aid device (200 or 300, respectively). An optional cushion or padding 509 may be applied between the bottom of the cylindrical support base 505 and the circular patch 507 to provide comfort when worn by the golfer. The optional cushion or padding 509 may be made from materials such as rubber, neoprene, foam, wool, feathers, polyester fiber, non-woven material, or even soft paper.

Figure 6A:
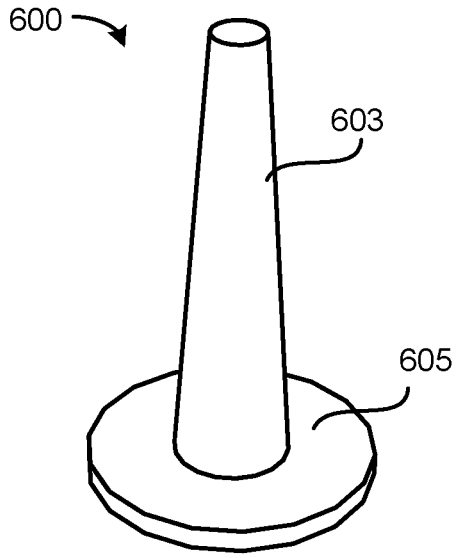
FIG. 6A illustrates a perspective view of a tapered clubface guide post of the hand wearable visual training aid device, in accordance with an embodiment.
Figure 6B:
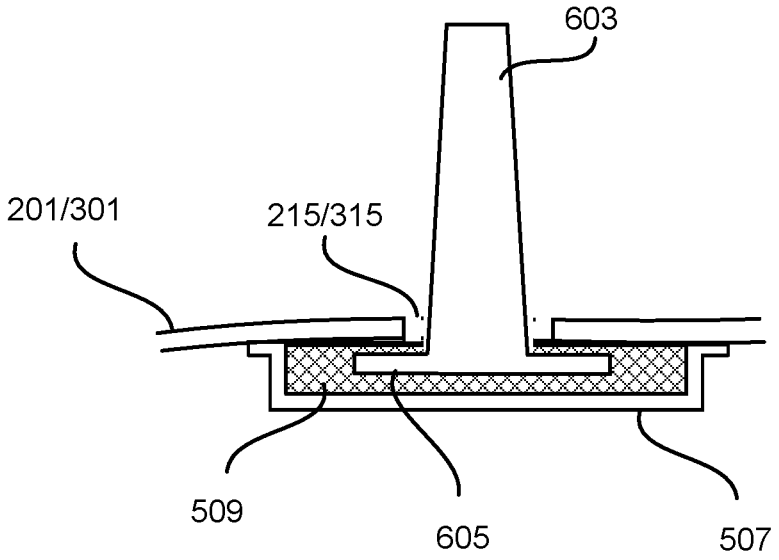
FIG. 6B illustrates a cross-sectional view of a tapered clubface guide post mounted to the hand wearable visual training aid device, in accordance with an embodiment.

FIG. 6A illustrates a perspective view of a tapered clubface guide post 600 of the hand wearable visual training aid device, in accordance with another embodiment. Members of the tapered clubface guide post 600 include an elongated tapered cylindrical tube or rod 603 mounted to the center of a thin cylindrical support base 605. In practice, the dimensions of the elongated tapered cylindrical tube or rod 603 may be approximately 2.5 inches to 4 inches in length with a radius of ¼ inch to ½ inch at the top of the tube 603, and a radius of ⅛ inch to ¼ inch at the bottom of the tube 603. The dimensions of the thin cylindrical support base 605 are similar to the previous example, measuring approximately ⅛ inch to ½ inch in length and having a radius of ½ inch to 1 inch. FIG. 6B illustrates a cross-sectional view of a tapered clubface guide post mounted to the hand wearable visual training aid device. Mounting techniques and materials used for mounting as described in the previous example hereinabove may be used to mount and fasten the tapered clubface guide post mounted to the hand wearable visual training aid device (200, 300).

Figure 7:
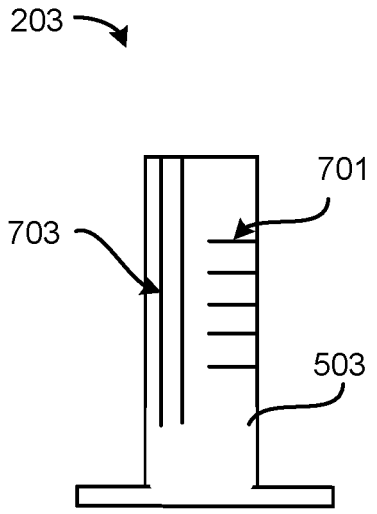
FIG. 7 illustrates a cross-sectional view of a clubface guide post with linear markings of the hand wearable visual training aid device, in accordance with an embodiment.

FIG. 7 illustrates a cross-sectional view of the clubface guide post 203 with horizontal linear markings 701 and vertical linear markings 703 applied via printed adhesive stickers or directly imprinted on the surface of the tube or rod 503, in accordance with an embodiment. The horizontal and vertical linear markings provide the golfer additional guide lines to assist in the positioning the clubface, keeping the clubface square to the golf ball as described later herein below.

Figure 8:
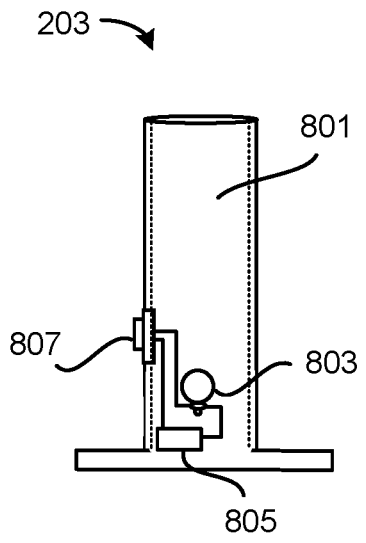
FIG. 8 illustrates a cross-sectional view of an illuminated clubface guide post of the hand wearable visual training aid device, in accordance with an embodiment.

FIG. 8 illustrates a cross-sectional view of the clubface guide post 203 having an illuminated elongated cylindrical hollow tube 801, in accordance with another embodiment. The interior of the illuminated elongated cylindrical hollow tube 801 may include a light source 803 (e.g., LED, incandescent, or the like), a battery source 805 electrically supplying power to the light source 803, and a switch 807, electrically connected between the light source 803 and the battery source 805, for enabling and disabling the light source 803. In an optional configuration, the switch may be replaced with a motion activated sensor device to power on and power off the light source 803. In practice, the illuminated elongated cylindrical hollow tube 801 of the hand wearable visual training aid device enhances the visual appearance of the clubface guide post 203 used for guiding and positioning the clubface of the golf club.

Figure 9A:
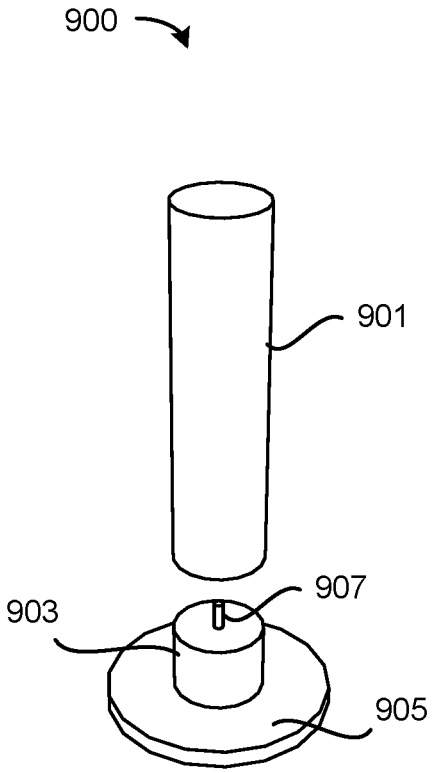
FIG. 9A illustrates a perspective view of a detachable clubface guide post of the hand wearable visual training aid device, in accordance with an embodiment.
Figure 9B:
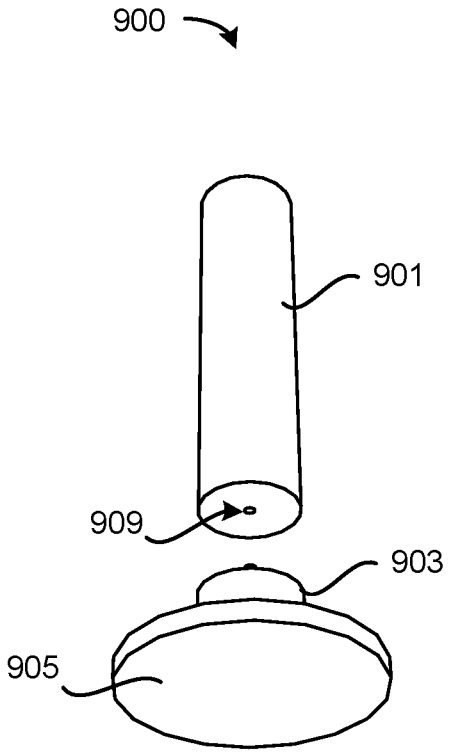
FIG. 9B illustrates another perspective view of the detachable clubface guide post of the hand wearable visual training aid device, in accordance with an embodiment.

FIG. 9A and FIG. 9B illustrate perspective views of a detachable clubface guide post 900, in accordance with another embodiment. The detachable clubface guide post 900 includes an elongated cylindrical tube or rod 901 that may be attached and detached to a base support post 903 that is connected to a thin cylindrical support base 905. A threaded screw 907 may be attached to the center of the top of the base support post 903 while a corresponding receiving threaded hole 909 having an optional threaded nut inserted into the threaded hole 909 is formed at the center of the bottom end of the cylindrical tube or rod 901. Attaching and detaching the cylindrical tube or rod 901 to the base support post 903 is generally accomplished by fastening the threaded hole 909 to the threaded hole 909. The advantages of the detachable clubface guide post 900 include ease of removal, ease of storage, and parts replacement.

Figure 10:
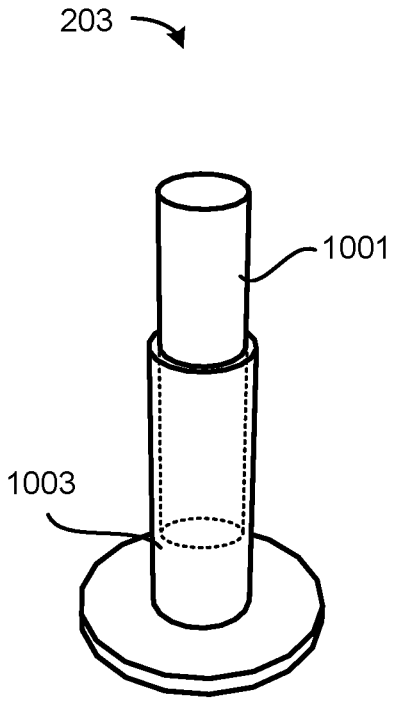
FIG. 10 illustrates a perspective view of a clubface guide post with an extending member insert, in accordance with an embodiment.

FIG. 10 illustrates a perspective view of the clubface guide post 203 with an extending member insert 1001, in accordance with an embodiment. The clubface guide post 203 may include an elongated cylindrical hollow tube 1003 for receiving the extending member insert 1001. A snug and form fit of the extending member insert 1001 into the elongated cylindrical hollow tube 1003 allows for ease of pushing and pulling the extending member insert 1001 into and out of the elongated cylindrical hollow tube 1003 while still being supported by the elongated cylindrical hollow tube 1003. In practice, the extending member insert 1001 can provide additional visual enhancements to the clubface guide post 203 and may further aid the golfer with positioning the clubface.

Figure 11A:
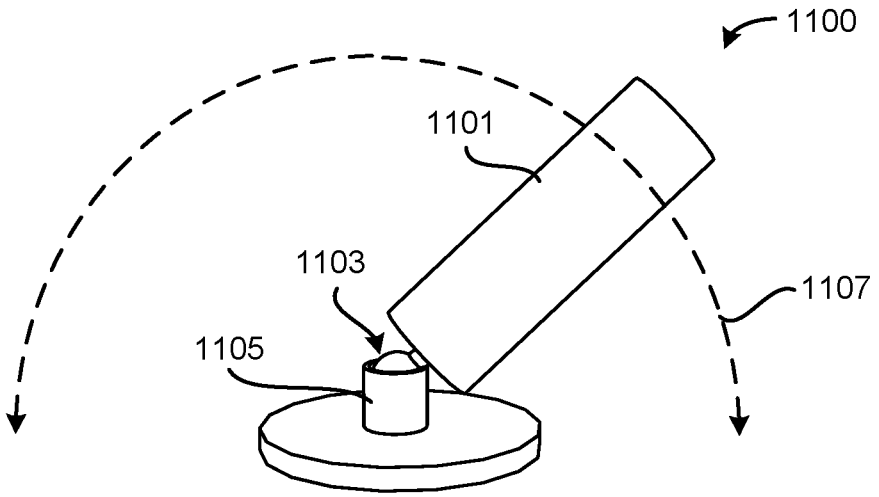
FIG. 11A illustrates a side perspective view of an adjustable clubface guide post of the hand wearable visual training aid device, in accordance with an embodiment.
Figure 11B:
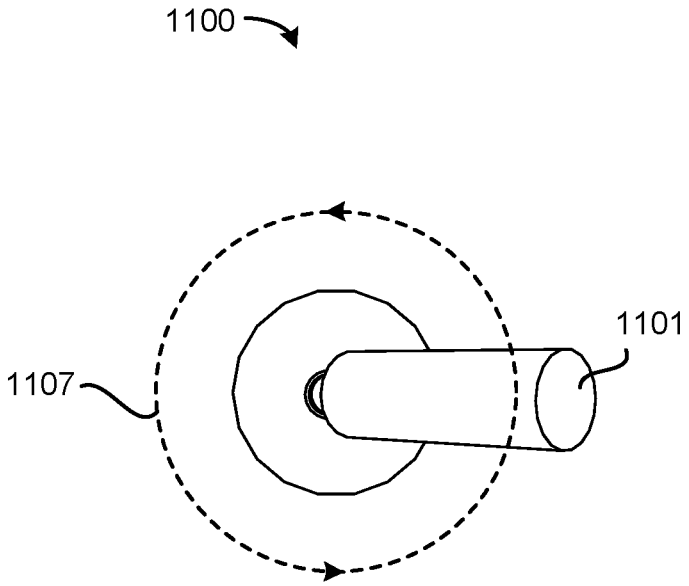
FIG. 11B illustrates a front perspective view of the adjustable clubface guide post of the hand wearable visual training aid device, in accordance with an embodiment.

FIG. 11A and FIG. 11B illustrate a side and a front perspective view of an adjustable clubface guide post 1100, in accordance with another embodiment. The adjustable clubface guide post 1100 includes an elongated cylindrical tube or rod 1101 that may be attached to a base support post 1105 using a ball joint 1103, allowing the elongated cylindrical tube or rod 1101 to be rotated between −180 degrees and 180 degrees from side to side 1107 and rotated a full 360 degrees from the top 1109. In practice, the adjustable clubface guide post 1100 may allow the golfer to fine tune and adjust the elongated cylindrical tube or rod 1101 in various rotatable directions so that it may further aid the golfer with positioning the clubface guide post 1100 to the clubface.

Figure 12A:
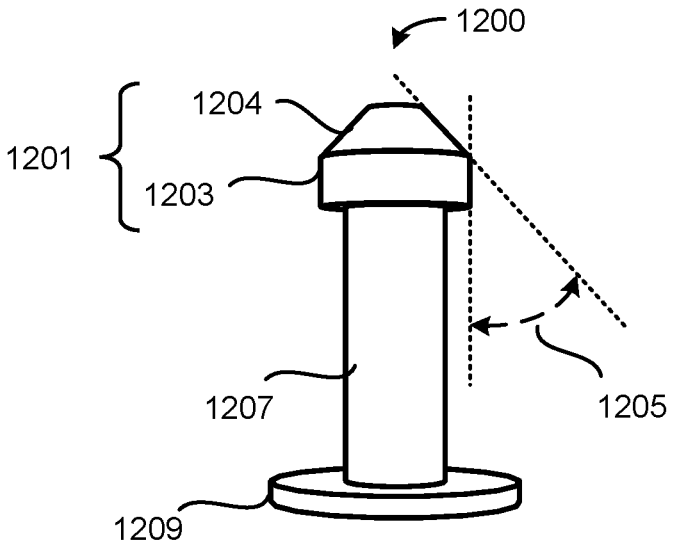
FIG. 12A illustrates a side view of a cone-shaped head affixed to the clubface guide post, in accordance with an embodiment.
Figure 12B:
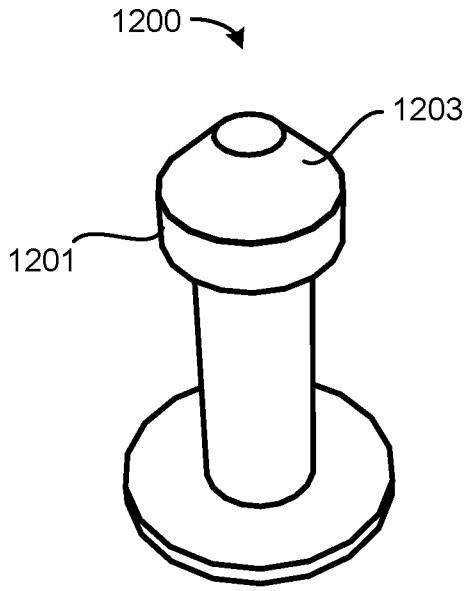
FIG. 12B illustrates a front perspective view of the cone-shaped head affixed to the clubface guide post, in accordance with an embodiment.

FIG. 12A (side view) and FIG. 12B (front perspective view) illustrate another aspect of a clubface guide post 1200. In this embodiment, the hand wearable visual training aid device may include a cone-shaped head 1201 affixed to the clubface guide post. The cone-shaped head 1201 may include a cylindrical base 1203 and a pointed cone-shaped cylinder end 1204 forming an acute angle 1205 between the sidewall of the cylindrical base 1203 and the slope of the pointed cone-shaped cylinder end 1204. Similar to the previous embodiments, the cylindrical base 1203 of the cone-shaped head 1201 may be attached to an elongated cylindrical tube or rod 1207 mounted to the center of a thin cylindrical support base 1209.

Figure 13A:
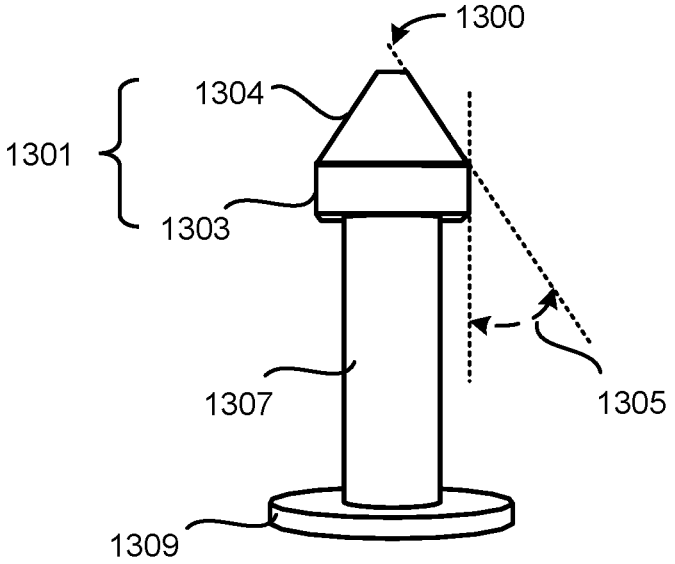
FIG. 13A illustrates a side view of a tetrahedron-shaped head attached to the clubface guide post, in accordance with an embodiment.
Figure 13B:
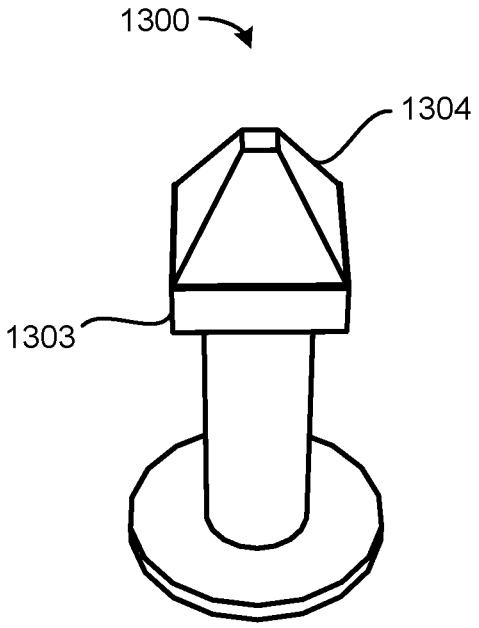
FIG. 13B illustrates a front perspective view of the tetrahedron-shaped head attached to the clubface guide post, in accordance with an embodiment.

FIG. 13A (side view) and FIG. 13B (front perspective view) illustrate another aspect of a clubface guide post 1300. In this embodiment, the hand wearable visual training aid device may include a tetrahedron-shaped head 1301 attached to the clubface guide post. In this embodiment, the tetrahedron-shaped head 1301 may include a rectangular cuboid base 1303 and a tetrahedron-shaped member 1304 forming an acute angle 1305 between the sidewall of the rectangular cuboid base 1303 and the slope of the tetrahedron-shaped member 1304. The rectangular cuboid base 1303 of the tetrahedron-shaped head 1301 is attached to an elongated cylindrical tube or rod 1307 mounted to the center of a thin cylindrical support base 1309.

For both clubface guide post embodiments 1200 and 1300, the application, function and dimensions of the elongated cylindrical tube or rod mounted to the center of the thin cylindrical support base are similar to the application, function and dimensions of like components shown in FIG. 5A.

In practice, the clubface guide post embodiments 1200 and 1300 can provide additional pointing reference features that may assist the golfer with adjusting and aligning the wrist to the clubface of the golf club. In other implementations, the other heads may applied to the clubface guide post such as a hexagonal shaped head, a ellipsoidal head, an arrow shaped head, or other similarly shaped heads that may be used as a pointing reference.

Figure 14:
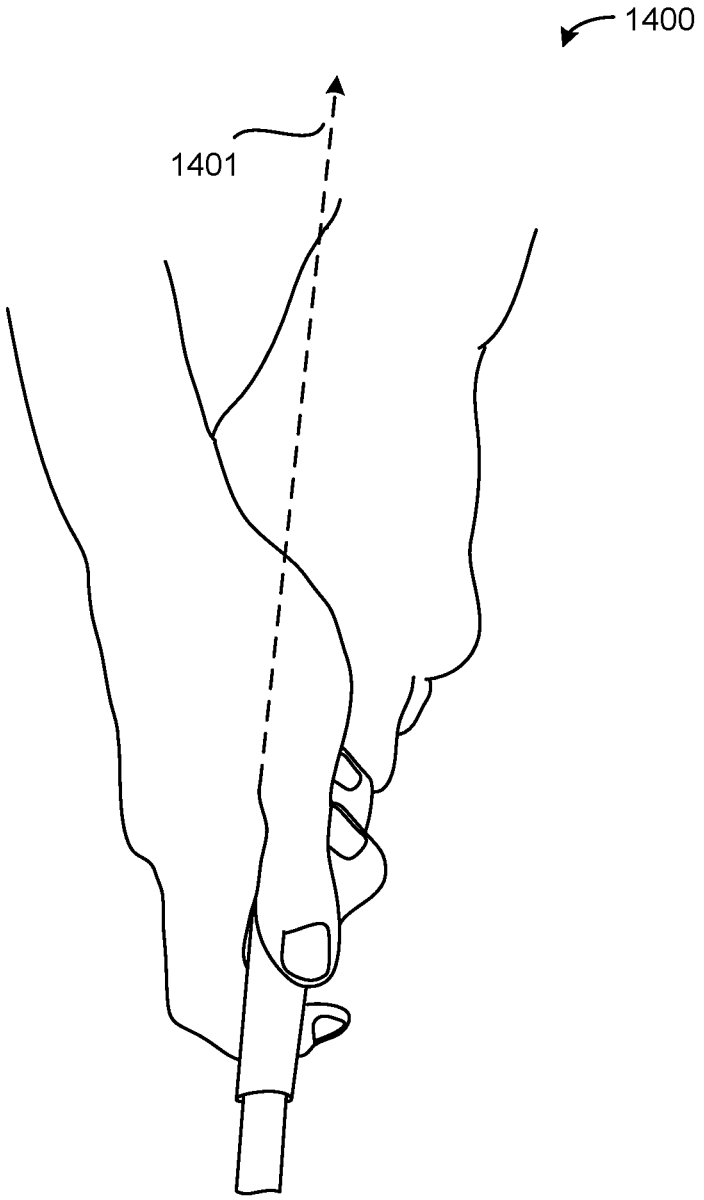
FIG. 14 illustrates a front view of the golfer gripping the grip of a golf club in a neutral position.

FIG. 14 illustrates a front view of a right-handed golfer gripping the grip of a golf club in a neutral position 1400 at address. A correct golf grip may assist the golfer to achieve more distance and accuracy, greater feel, improved ball striking and more consistency. In the neutral position, the fleshy pad of the right thumb is placed directly on top of the left thumb. Here, a 'V' made between the right thumb and forefinger and generally points to shoulder of the golfer along dotted lines 1401.

Figure 15:
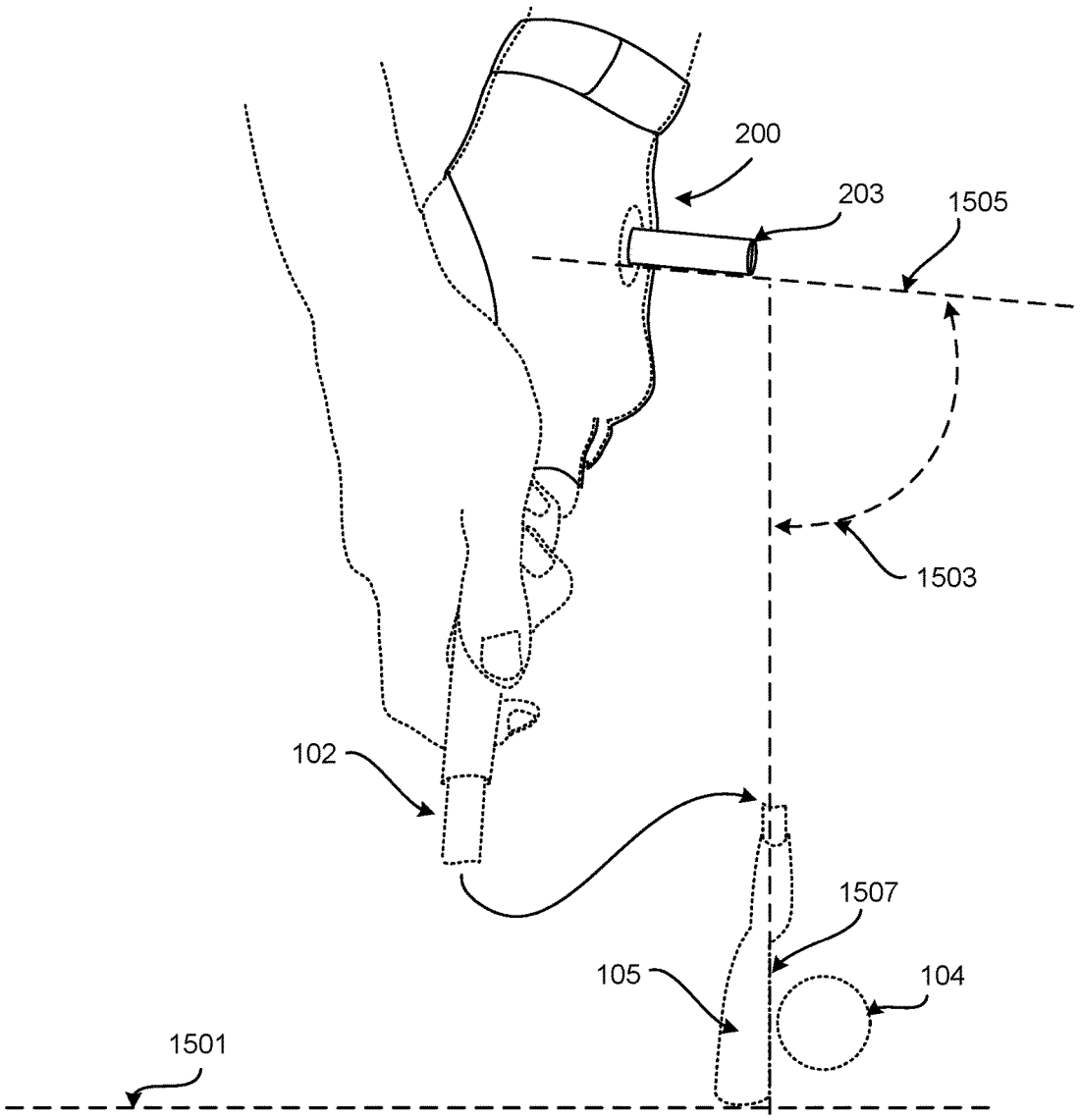
FIG. 15 illustrates a front view of the hand wearable visual training aid device worn by the golfer, gripping the golf club in the neutral position.

FIG. 15 illustrates a front view of the hand wearable visual training aid device 200 worn by the golfer, gripping the golf club in the neutral position at address. A break-apart depiction of the clubface 105 of the golf club 102 is presented at the bottom right corner of FIG. 15 for demonstration purposes. In the address position, the clubface guide post 203, clubface 105 of the golf club 102, golf ball 104, and imaginary target line 1501 are in the general line of sight of the golfer. In this example at address position, the leading edge along projected path 1505 of the clubface guide post 203 should appear slightly off angle 1503 (i.e., not square) with respect to the leading edge 1507 of the clubface 105. The clubface guide post 203 is slightly off angle due to the wrist slightly pointing at a downward position at address, which is typical while the golfer holds the grip in the neutral position.

Figure 16:
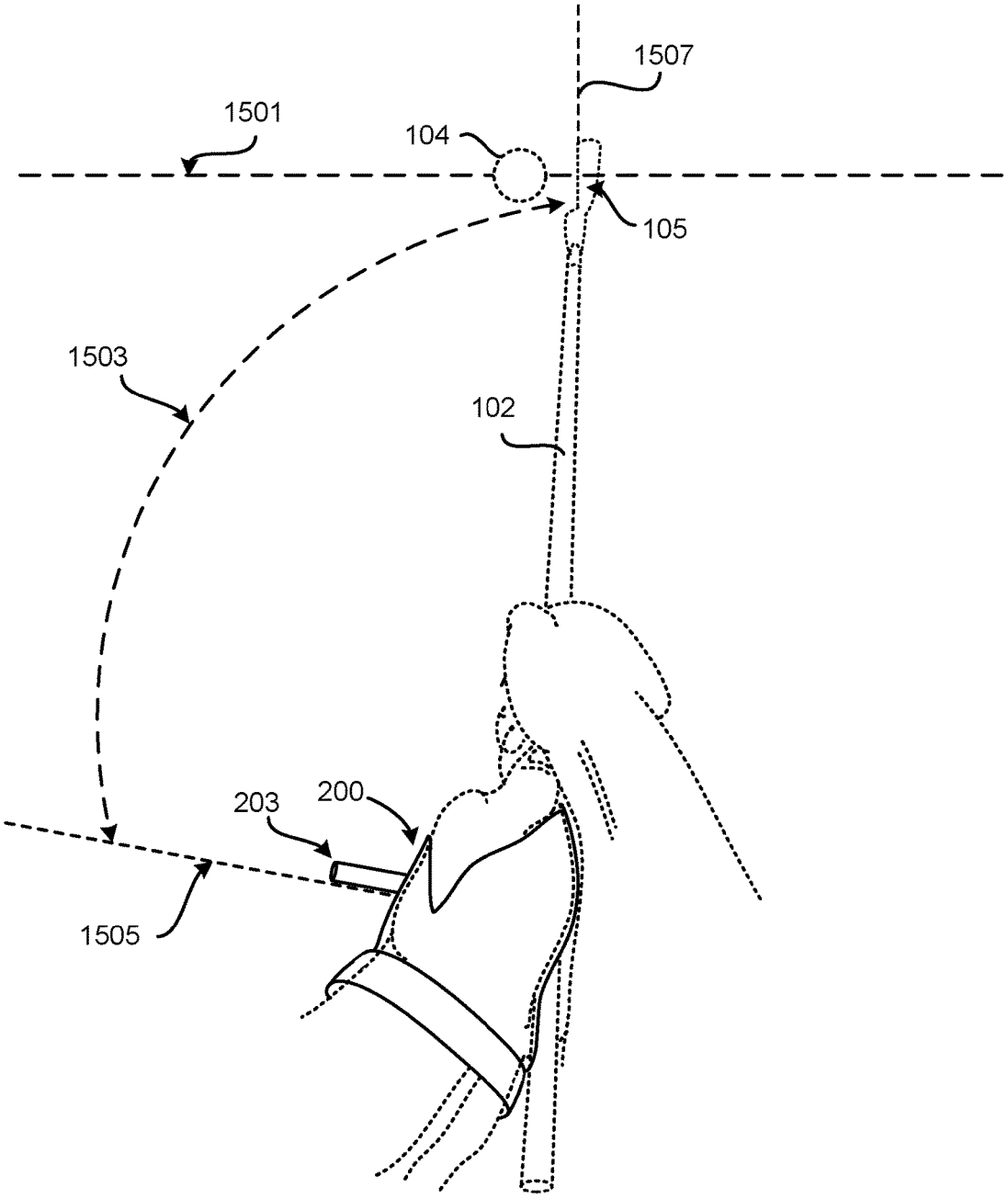
FIG. 16 illustrates a top view of the hand wearable visual training aid device worn by the golfer, gripping the golf club in the neutral position at address.

FIG. 16 illustrates a top view of the hand wearable visual training aid device 200 worn by the golfer, gripping the golf club in the neutral position at address. FIG. 16 provides a different view of FIG. 15 illustrating like elements. In FIG. 16, a better view of the angle 1503 is depicted. As in the case in the previous example, the leading edge along projected path 1505 of the clubface guide post 203 should appear slightly off angle 1503 (i.e., not square) with respect to the leading edge 1507 of the clubface 105 while in practice. Furthermore, it is apparent from the top view that the leading edge along projected path 1505 of the clubface guide post 203 is not parallel to the imaginary target line 1501.

Figure 17:
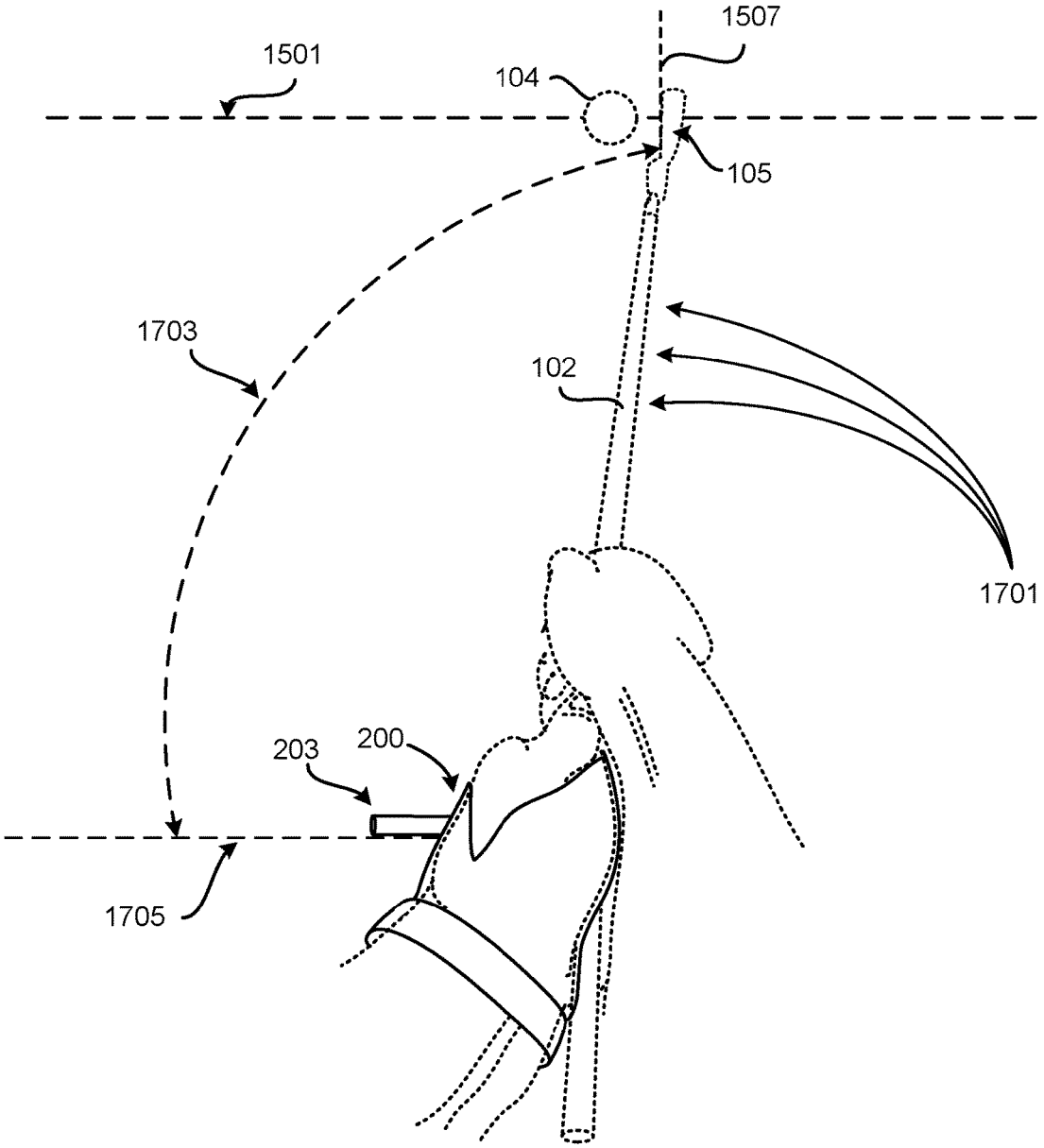
FIG. 17 illustrates a top view of the hand wearable visual training aid device worn by the golfer at impact position while gripping the golf club in the neutral position.

FIG. 17 illustrates a top view of the hand wearable visual training aid device 200 worn by the golfer at impact position while gripping the golf club in the neutral position. Here, the golfer performs a backswing of the golf club 102 starting at the backswing position 1701 and ending at the impact position (i.e., the point of contact to the golf ball 104). At the impact position, the clubface guide post 203 of the hand wearable visual training aid device 200 is also clearly visible to the golfer's field of view, along with the clubface 105 of the golf club 102, golf ball 104, and imaginary target line 1501. Prior to impact of the golf ball 104, the wrist of the golfer should be rotated so that the leading edge along projected path 1705 of the clubface guide post 203 is approximately square (or perpendicular) 1703 to the clubface 105 (between lines 1507 and 1705). In practice, the golfer may also rotate their wrist so that the clubface guide post 203 is parallel to the imaginary target line 105 prior to impact.

In one aspect and advantage, the hand wearable visual training aid device 200 facilitates proper rotation of the wrist of the golfer which, in turn, promotes proper clubface alignment prior to impact, providing a better strike and center hit for achieving greater accuracy and distance on the golf ball.

In another aspect and advantage, the hand wearable visual training aid device 200 is lightweight, adjustable and may be worn with or without golfing gloves, providing an ergonomic and comfortable fit while being worn by the golfer 100.

In yet another advantage, the hand wearable visual training aid device 200 includes various configurations to enhance the visual reference of the clubface 105 including a tapered design, an adjustable/rotatable post design, and a extending post design, providing a better strike and center hit for achieving greater accuracy and distance on the golf ball.

As used in the specification and the appended claims, the singular forms "a", "an", and "the" included plural referents unless the context clearly dictates otherwise.

All patents, patent applications, and other references cited herein are incorporated by reference in their entireties.

It is noted that the foregoing disclosure has been provided merely for the purpose of explanation and is in no way to be construed as limiting of the present invention. Although the present invention has been shown and described with respect to several preferred embodiments thereof, various changes, omissions, and additions to the form and detail thereof, may be made therein, without departing from the spirit and scope of the invention. It is understood that the words which have been used herein are words of description and illustration, rather than words of limitation. Changes may be made, within the purview of the appended claims, as presently stated and as amended, without departing from the scope and spirit of the present invention in its aspects.

Other embodiments and modifications of the present invention may occur to those of ordinary skill in the art in view of these teachings. Accordingly, the invention is to be limited only by the following claims which include all other such embodiments and modifications when viewed in conjunction with the above specifications and accompanying drawings.

What is claimed is what is described and illustrated, including:

1. A hand wearable visual training aid device for use with a golf club having a clubface, the hand wearable visual training aid device comprising:

a glove having a top side, a palm side opposite to the top side, a wrist end, a plurality of openings opposite to the wrist end; and a clubface guide post coupled to the top side of the glove and substantially centrally positioned to the top side of the glove, wherein the clubface guide post provides a visual reference for aligning the clubface of the golf club to a golf ball, wherein the clubface guide post includes an elongated tube coupled to a base support post using a swivel ball joint.

2. The hand wearable visual training aid device of claim 1, wherein the clubface guide post is substantially perpendicular to the top side of the glove.

3. The hand wearable visual training aid device of claim 1, wherein a hole is formed in the glove for receiving the clubface guide post.

4. The hand wearable visual training aid device of claim 1, wherein the clubface guide post includes an elongated tube coupled to a top side of a support base, wherein the support base further includes a bottom side opposite to the top side.

5. The hand wearable visual training aid device of claim 4, wherein the clubface guide post is secured to the glove by a patch, wherein a padding is applied between the bottom side of the support base and the patch.

6. The hand wearable visual training aid device of claim 4, wherein the elongated tube is defined by a hollow interior having an interior wall, wherein an illuminate light source is coupled to the interior wall of the elongated tube.

7. The hand wearable visual training aid device of claim 4, wherein the clubface guide post includes an extending member insert coupled to the elongated tube.

8. The hand wearable visual training aid device of claim 1 further comprising a wrist support strap attached to the wrist end of the glove.

9. The hand wearable visual training aid device of claim 1, wherein the clubface guide post includes a tapered elongated tube coupled to a support base.

10. The hand wearable visual training aid device of claim 1, wherein the clubface guide post includes a pointing member attached to a distal end of the clubface guide post, wherein the pointing member is tetrahedron-shaped or cone-shaped.

11. A hand wearable visual training aid device for use with a golf club having a clubface, the hand wearable visual training aid device comprising:

a hand strap having a top side, a palm side opposite to the top side, a first end, a second end opposite to the first end, and a back hand support pad coupled to the top side of the hand strap;

a fastener applied to the first end and the second end of the hand strap;

a clubface guide post coupled to the top side of the hand strap and substantially centrally positioned to the top side of the hand strap, wherein the clubface guide post provides a visual reference for aligning the clubface of the golf club to a golf ball, wherein the clubface guide post includes an elongated tube coupled to a base support post using a swivel ball joint.

12. The hand wearable visual training aid device of claim 11, wherein the clubface guide post is substantially perpendicular to the top side of the hand strap.

13. The hand wearable visual training aid device of claim 11, wherein the fastener is a hook and loop fastener.

14. The hand wearable visual training aid device of claim 11, wherein a hole is formed in the hand strap for receiving the clubface guide post.

15. The hand wearable visual training aid device of claim 11, wherein the clubface guide post includes an elongated tube coupled to a top side of a support base, wherein the support base further includes a bottom side opposite to the top side.

16. The hand wearable visual training aid device of claim 15, wherein the clubface guide post is secured to the hand strap by a patch, wherein a padding is applied between the bottom side of the support base and the patch.

17. The hand wearable visual training aid device of claim 15, wherein the elongated tube is defined by a hollow interior having an interior wall, wherein an illuminate light source is coupled to the interior wall of the elongated tube.

18. The hand wearable visual training aid device of claim 15, wherein the clubface guide post includes an extending member insert coupled to the elongated tube.

* * * * *